US009819156B2

(12) United States Patent
Krebs et al.

(10) Patent No.: US 9,819,156 B2
(45) Date of Patent: Nov. 14, 2017

(54) SPARK PLUG HAVING A SEAL MADE OF AN AT LEAST TERNARY ALLOY

(71) Applicant: Robert Bosch GmbH, Stuttgart (DE)

(72) Inventors: Holger Krebs, Erdmannhausen (DE); Sabrina Rathgeber, Gerlingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/327,151

(22) PCT Filed: Jul. 6, 2015

(86) PCT No.: PCT/EP2015/065320

§ 371 (c)(1),
(2) Date: Jan. 18, 2017

(87) PCT Pub. No.: WO2016/030064

PCT Pub. Date: Mar. 3, 2016

(65) Prior Publication Data

US 2017/0179688 A1 Jun. 22, 2017

(30) Foreign Application Priority Data

Aug. 27, 2014 (DE) ..... 10 2014 217 084

(51) Int. Cl.
*H01T 13/20* (2006.01)
*H01T 13/36* (2006.01)

(52) U.S. Cl.
CPC ..... *H01T 13/36* (2013.01)

(58) Field of Classification Search
CPC ..... H01T 13/36
USPC ..... 313/141, 130
See application file for complete search history.

(56) References Cited

U.S. PATENT DOCUMENTS 3,407,050 A 10/1968 Trapp
7,215,069 B2 * 5/2007 Suzuki ..... H01T 13/36 313/143
2006/0066196 A1 3/2006 Suzuki
2006/0284535 A1 12/2006 Ozeki et al.

FOREIGN PATENT DOCUMENTS

CN 1627578 A 6/2005
CN 201318242 Y 9/2009
CN 102576984 A 7/2012
DE 4308371 A1 10/1993
(Continued)

OTHER PUBLICATIONS

Greetham, Geoff., "Innovations: Phosphor Bronze: Teaching an Old Dog New Tricks" Nov. 18, 2013.
(Continued)

*Primary Examiner* — Vip Patel
(74) *Attorney, Agent, or Firm* — Norton Rose Fulbright US LLP; Gerard Messina

(57) ABSTRACT

A spark plug having a housing, an insulator disposed in the housing, a center electrode situated in the insulator, a ground electrode disposed on the housing, and at least one sealing element, the at least one sealing element being situated on the housing, in particular between the insulator and the housing, wherein the at least one sealing element is made from an at least ternary alloy, and the alloy contains copper as the main constituent.

19 Claims, 1 Drawing Sheet

(56) References Cited

FOREIGN PATENT DOCUMENTS

| | | | |
|---|---|---|---|
| DE | 10125586 | A1 | 12/2001 |
| DE | 602005001743 | T2 | 4/2008 |
| DE | 602006000495 | T2 | 2/2009 |
| JP | H02263941 | A | 10/1990 |
| WO | 2014013723 | A1 | 1/2014 |

OTHER PUBLICATIONS

International Search Report dated Nov. 5, 2015, of the corresponding International Application PCT/EP2015/065320 filed Jul. 6, 2015.

* cited by examiner

SPARK PLUG HAVING A SEAL MADE OF AN AT LEAST TERNARY ALLOY

BACKGROUND INFORMATION

In modern spark plugs, seals or sealing elements are used at different locations of the spark plug in order to ensure that the spark plug installed in the engine block or in the spark plug bore is gas-tight with respect to the gases present in the combustion chamber. In addition to an external seal for sealing the transition from the spark-plug housing to the spark-plug bore, at least one internal seal is provided, which is also referred to as internal sealing disk or internal sealing ring, which seals the gap between the housing and insulator.

Due to the specific demands, such as temperature resistance and deformability, imposed on a spark plug seal and in particular on the internal seals, metal seals such as seals made from steel or copper or aluminum are employed in spark plugs. The internal seal is meant to seal the gap between spark-plug housing and spark-plug insulator in a reliable manner across the entire temperature range of approximately −40° C. up to approximately 350° C. to which the spark plug is exposed.

It is an object of the present invention to provide spark plugs that have an improved sealing effect.

SUMMARY

In accordance with example embodiments of the present invention, a sealing element that is ideal for the spark plug, such as an internal seal, is made from a material that satisfies the various requirements, such as excellent deformability, corrosion resistance and temperature stability.

Overall, the sealing elements used in the spark plug should be pressure-resistant, especially with respect to pressures of up to 200 bar, in order to withstand the pressures prevailing in the combustion chamber during the engine operation, and they should seal the gap between the components to be sealed in a preferably gas-tight manner, i.e., so that the leakage rate of the transition between the components to be sealed is ideally less than $10^{-7}$ mbar*l/s.

Every material for conventional sealing elements. in particular for the internal seal, of the spark plugs has advantageous and less advantageous, i.e., undesired, material properties. For instance, the materials copper and aluminum provide excellent deformability and high thermal conductivity as well as fairly good corrosion resistance in comparison with steel. On the other hand, steel usually has greater hardness than copper or aluminum.

Metallic sealing elements, like most seals, also achieve the sealing effect by wedging the metallic sealing element between the components to be sealed. The sealing element must deform in the process. The deformability of the material depends on various material properties such as the percent elongation at failure A or the modulus of elasticity E as well as on external conditions, such as the temperature. In the case of metallic sealing elements, the deformation typically takes place in the area of plastic deformation, and the area of the elastic deformation is passed through first. Percent elongation at failure A is a measure of how far the material is able to be deformed beyond its elastic deformation range before it tears. Modulus of elasticity E is a measure of the particular resistance by which a material opposes an in particular elastic deformation or the deformation force. The lower the modulus of elasticity, the easier a material is able to be deformed in a first approximation.

The term temperature-stable usually refers to the fact that a material or a component does not change its primary function or change it for the worse, such as the sealing in the case of a sealing element, as a function of the temperature. The temperature stability may be assessed with regard to various aspects, e.g., for the deformation stability or for the chemical resistance or corrosion resistance. On the whole, it has shown to be advantageous that the material used for the internal seal is temperature-stable at a temperature up to at least 550° C.

Deformation resistance usually means that the material retains its shape or geometry even when the temperature changes. The hardness of a material or the change in the hardness of a material as a function of the temperature is a measure of the deformation resistance. There are various testing methods for ascertaining the hardness of a material. The hardness values mentioned here were ascertained in accordance with the Vickers method (DIN EN ISO 6507-1 to 6507-4).

Chemical resistance or corrosion resistance (DIN EN ISO 8044:1999 corrosion) generally means that the material is resistant to a physicochemical reciprocal action with its environment even when a change in the ambient temperature occurs. In the process, the physicochemical reciprocal action may result in a change in the properties of the material, which in turn can lead to considerable detrimental effects on the function of the material or the component made of said material.

For a material according to the present invention, this means that the material for the sealing elements should be oxidation-resistant and/or corrosion-resistant and/or dimensionally stable under the conditions typically encountered during the operation of the spark plug, in particular at pressures of up to 200 bar and temperatures of up to 400° C., so that the sealing element does not lose its sealing properties during the operation and the spark plug has a longer service life.

In addition, excellent thermal conductivity of the material is advantageous, especially when the material is used for the internal seal in the spark plug. The spark plug absorbs heat from the combustion chamber, and the primary heat dissipation for cooling the center electrode and the insulator of the spark plug takes place by way of the sealing element situated between the insulator and the cooled housing. A sealing element made of a material having poor thermal conductivity can change the thermal behavior of the spark plug in an undesired way.

A spark plug according to the present invention may have an advantage over the related art that at least one sealing element of the spark plug is made from a material that has as many of the desired material properties as possible.

The fact that at least one sealing element is made from an at least ternary alloy and the alloy contains copper (Cu) as the main constituent provides the advantage that the alloy has the desired material properties of copper, e.g., excellent deformability, excellent thermal conductivity and/or the coefficient of thermal expansion. Copper is the main constituent of the alloy, which means that copper constitutes the element that has the greatest individual share in the alloy.

Further advantageous refinements are described herein.

It may be advantageous if the alloy has a Cu content of no less than 40 wt. %. Preferably, the Cu content amounts to no less than 47 wt. %.

In a first advantageous further refinement, it may be provided that the Cu content of the alloy does not exceed 70 wt. %. In particular, the Cu content does not exceed 64 wt. %.

In addition or as an alternative, it may advantageously be provided that the alloy contains nickel (Ni). The Ni content of the alloy advantageously amounts to no less than 7 wt. %, and in particular no less than 10 wt. %. Additionally or alternatively, it is conceivable that the Ni content of the alloy does not exceed 30 wt %, in particular does not exceed 26 wt. % or does not exceed 25 wt. %. The admixture of nickel in the alloy improves the corrosion resistance and the stability or hardness of the alloy.

Overall, it may be advantageous if the alloy includes zinc (Zn). The Zn content of the alloy advantageously is no less than 10 wt. % and/or no greater than 50 wt. %. Especially advantageous is a Zn content of the alloy of no less than 15 wt. % and/or no greater than 42 wt. %. The admixture of zinc in the alloy increases the stability or hardness of the alloy. At the same time, the material costs of the alloy are lowered by the Zn content.

The combination of copper, nickel and zinc in an alloy in the indicated proportions achieves the technical effect of providing the alloy with higher corrosion resistance and better deformability or better elasticity than steel, and greater stability or greater hardness than pure copper. In particular on account of the higher corrosion resistance, the alloy is well suited for use in the spark plug since the alloy withstands the high temperatures and the aggressive ambient conditions in the combustion chamber during the spark plug operation.

Nickel and zinc are completely soluble in copper in the aforementioned concentration ranges; in other words, a homogeneous alloy forms (a-solid solution), which has no or barely any regions of varying element concentrations so that the material properties of the alloys are spatially constant.

In addition, the alloy may also include still further elements such as lead (Pb), iron (Fe) and/or manganese (Mn). The lead content of the alloy typically lies at up to 2.5 wt %. The lead improves the machining properties of the alloy, such as during lathing, milling, drilling or other processing techniques according to DIN 8589-0 through DIN 8589-17. The addition of manganese to the alloy reduces the annealing brittleness of the alloy, i.e., the tendency of the material to break at high temperatures. The manganese content of the alloy amounts to up to 0.7 wt. %, for example.

In a second advantageous further development, it may be provided that the Cu content of the alloy is no less than 75 wt. %. In particular, the Cu content amounts to no less than 98 wt. %. In addition or as an alternative, it may be provided that the alloy contains chromium (Cr), the Cr content of the alloy in particular being no less than 0.2 wt. %. Additionally or alternatively, it may also be provided that the Cr content of the alloy does not exceed 1 wt. %, and in particular does not exceed 0.6 wt. %.

In addition or as an alternative, it may advantageously be provided that the alloy contains titanium (Ti), the Ti content of the alloy in particular being no less than 0.05 wt. %. Additionally or alternatively, it may also be provided that the Ti content of the alloy does not exceed 0.15 wt. %, and in particular does not exceed 0.1 wt. %.

In addition or as an alternative, it may advantageously be provided that the alloy includes silicon (Si), the Si content of the alloy in particular being no less than 0.01 wt. % and in particular no less than 0.02 wt. %. Alternatively or additionally, it may also be provided that the Si content of the alloy does not exceed 0.05 wt. %, and in particular does not exceed 0.03 wt. %.

In addition, the alloy may include still further elements such as silver (Ag) and/or iron (Fe). The Ag content of the alloy preferably does not exceed 0.3 wt. %. For instance, the Fe content of the alloy amounts to less than 0.1 wt. %.

The admixture of chromium, titanium and/or silicon to copper in the indicated proportions results in the technical effect of providing the Cu alloy with greater hardness or stability than pure copper. The deformation resistance of the alloy is better than that of pure copper.

The alloy, in particular according to the first or the second further development, may also include a certain proportion of impurities such as further elements or oxides. The impurities or oxides are not selectively added to the alloy but are unavoidable or can be avoided or reduced only at great effort as a result of the element-producing processes, the production process of the alloy and/or or the storage conditions. Impurities of a slight scale are usually negligible since they have no essential influence on the material properties of the at least ternary alloy.

The alloy, e.g., according to the first and second further refinement, preferably has a modulus of elasticity E of less than or equal to 150 GPa.

The coefficient of thermal expansion a of the alloy according to the first and the second further refinement, for instance, is no less than $15*10^{-6}$ 1K and/or no greater than $20*10^{-6}$ 1/K. Preferably, the coefficient of thermal expansion lies in the range from $17*10^{-6}$ 1/K to $18*10^{-6}$ 1/K.

The thermal conductivity of the alloy according to the first and second further refinement, for example, should be no less than 30 W/mK. Ideally, the thermal conductivity of the alloy according to the second further refinement, for instance, amounts to at least 300 W/mK.

The hardness of the alloy according to the first and the second further refinement, for example, is typically no lower than 80 HV and/or no greater than 260 HV, the hardness test being carried out according to Vickers. For instance, it is advantageously provided that the hardness of the alloy according to the first further refinement lies in the range from 85 to 250 HV, the limits being part of the range. The hardness of the alloy according to the second further refinement may lie in the range from 120 to 190 HV, for instance.

It is advantageously provided that the hardness of the alloy according to the first and the second further refinement, for instance, is not reduced by more than 30% for temperatures up to 550° C., the hardness of the alloy at room temperature being used as the base value, and the alloy having the temperature of up to 550° C. for a maximum of 30 minutes. In particular, the hardness is reduced by maximally 22% under the aforementioned conditions.

The sealing element made of the alloy is annular. It may have a round or a polygonal cross-section. In the case of a round cross-section, the diameter of the cross-section is no less than 0.4 mm and/or no greater than 2.0 mm. Preferably, the diameter of the cross-section is no greater than 1.5 mm. In the case of a polygonal cross-section, the sealing element has a height of no less than 0.4 mm, for example, and no greater than 2.0 mm. The width of the cross-section results from one half of the difference of the outer diameter and the inner diameter of the sealing element. For example, the width lies in the range from 0.5 mm to 1 mm.

The spark plug has a housing and an insulator situated in the housing. In one advantageous specific embodiment, it is provided that the sealing element of the at least ternary alloy is situated between the insulator and the housing. It is particularly advantageous if the sealing element is situated at the combustion-chamber-side end of the spark plug between insulator and housing. The housing typically has a shoulder, i.e., a reduction of the inner radius, on its inner side, in particular in a section of the housing that faces the combustion chamber. The insulator rests on this shoulder, which is also referred to as insulator seat. At least one sealing element may be situated between the insulator and insulator seat of the housing.

As an alternative or in addition, the external sealing element, i.e., the sealing element sealing the transition between spark-plug housing and spark-plug bore or engine block, may also be made from the at least ternary alloy. The external sealing element may be developed as a pleated seal.

DETAILED DESCRIPTION OF EXAMPLE EMBODIMENTS

Figure 1:
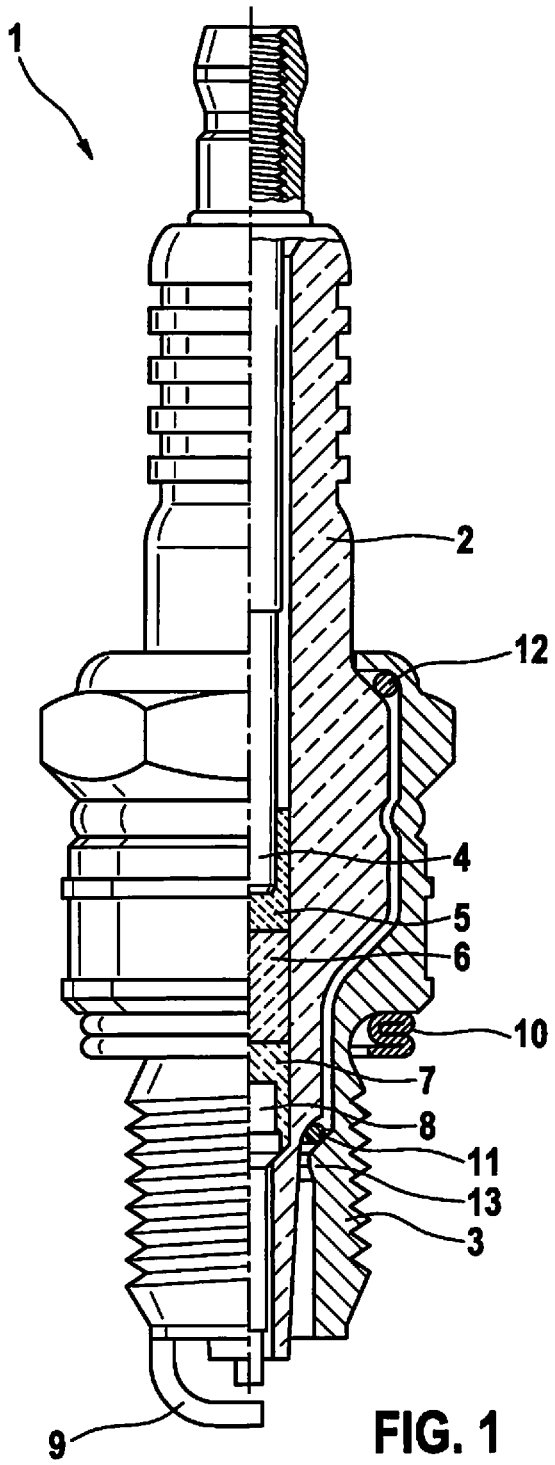
FIG. 1 shows an example of a spark plug according to the present invention.

FIG. 1 shows a schematic representation of a spark plug 1, which has a housing 3, an insulator 2 situated in housing 3, a center electrode 8 disposed in insulator 2, as well as a ground electrode 9 which is disposed on housing 3. Center electrode 8 and ground electrode 9 are placed in such a way with respect to one another that a spark gap is formed between their ends on the side of the combustion chamber. Ground electrode 9 and/or center electrode 8 may have wear surfaces of a corrosion-resistant and/or erosion-resistant metal at their ends on the side of the combustion chamber; these may be made of a noble metal, for instance, such as Pt, Pd, Ir, Re and/or Rh, or a noble metal alloy.

In addition, a contact pin 4 is situated in insulator 2, via which spark plug 1 is contacted by an ignition coil (not shown here). The electrical contact between contact pin 4 and center electrode 8 is produced by a resistance element, also known as "panat." As shown in this exemplary embodiment, the resistance element may have a layer structure, for instance of two contact "panats" 5, 7 and a resistance "panat" 6. The three layers 5, 6, 7 differ in their material composition and by the resistance resulting from the material composition. The two contact "panats" 5, 7 may be made from different materials or from the same materials. In addition to the electrical contacting of contact pin 4 and center electrode 8, resistance element 5, 6, 7 also seals transition between the isolator—center electrode—contact pin with respect to the combustion chamber gases.

An external seal 10, such as a pleated seal, seals the transition between the housing and spark plug bore. Housing 3 has a thread, which is situated closer to the combustion chamber than external seal 10.

The part of housing 3 provided with the thread is referred to as combustion-chamber-side end of the housing. The rest of the housing which is facing away from the combustion chamber is referred to as the end of the housing facing away from the combustion chamber.

At least one internal seal 11, 12 is provided to seal the gap between insulator 2 and housing 3. A first internal seal 11 is situated in the region of the combustion-chamber-side end of the housing, in particular closer to the combustion chamber than external seal 10. External seal 10 is situated in closer proximity to the combustion chamber than a second internal seal 12. Second internal seal 12 is disposed in the area of the end of the housing that faces away from the combustion chamber, in particular in the area of a hexagonal bolt for installing the spark plug. For example, still further internal seals may be provided in the insulator-housing transition in addition to first internal seal 11 and second internal seal 12.

First internal seal 11 is situated in the region of the combustion-chamber-side end of spark plug 1 between insulator 2 and housing 3, in particular in the region of the root neck of the insulator. Housing 3, for example, may have a shoulder 13, also known as insulator seat, on its inner side of its end on the side of the combustion chamber; in other words, it has a local reduction of the inner diameter of the housing, which serves as bearing surface for first internal seal 11. Shoulder 13 on the inner side of the housing is also developed in the region of the end of the housing on the side of the combustion chamber, and in particular is situated closer to the combustion chamber than external seal 10.

As shown in FIG. 1, annular internal seals 11 may have a round cross-section. The diameter of the cross-section of internal seal 11 lies in a range from 0.4 to 2 mm.

Figure 2:
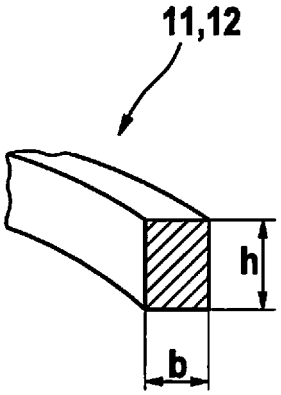
FIG. 2 shows an alternative cross-section of the internal seal.

As an alternative, as illustrated in FIG. 2, annular internal seals 11 may also have a polygonal, e.g., four-sided, cross-section. The cross-section of internal seal 11 features a height h in the range from 0.4 to 2 mm and/or a width b of 0.5 to 1 mm. If multiple internal seals 11, 12 are provided, these internal seals 11, 12 may have the same cross-section or a different cross-section.

At least one of internal seals 11, 12 and/or external seal 10 are/is made from the at least ternary alloy, the alloy containing Cu as the main constituent.

For instance, the alloy according to a first further refinement may include 47-64 wt. % copper, 10-25 wt. % nickel, 15-42 wt. % zinc, and up to 5 wt. % also lead, iron and/or manganese.

The three main constituents of an exemplary alloy A of the first further refinement are 18 wt. % nickel, 20 wt. % zinc, and copper as the rest. The hardness of this exemplary alloy lies in the range from 85-230 HV. The hardness of the alloy is reduced by maximally 15% at up to 550° C. for up to 30 minutes. The modulus of elasticity amounts to 135 GPa, while the lower limit of percent elongation at failure A lies in the range from 3% to 27%. The coefficient of thermal expansion of exemplary alloy A amounts to $17.7*10^{-6}$ 1/K, and the thermal conductivity amounts to 33 W/mK.

An exemplary alloy B of the first further refinement is made of 18 wt. % nickel, 27 wt. % zinc, and copper as the rest. The hardness of this exemplary alloy lies in the range from 90-250 HV. The hardness of the alloy is reduced by maximally 21% at up to 550° C. for up to 30 minutes. The modulus of elasticity is 135 GPa, while the lower limit of percent elongation at failure A lies in the range from 1% to 30% as a minimum. The coefficient of thermal expansion of exemplary alloy B amounts to $17.7*10^{-6}$ 1/K, and the thermal conductivity amounts to 32 W/mK.

The alloys according to the second further refinement contain at least 95 wt. % copper and at least two elements from the group chromium, titanium, silicon, silver and iron, and no element of the aforementioned group has a greater single share than 0.6 wt. % in the alloy.

Exemplary alloy C of the second further refinement is made up of 0.5 wt. % chromium, 0.2 wt. % silver, 0.08 wt. % iron, 0.06 wt. % titanium, 0.03 wt. % silicon, and copper as the rest. The hardness of this exemplary alloy lies in the range from 140-190 HV. The hardness of the alloy is reduced by maximally 15% at up to 550° C. for up to 30 minutes. The modulus of elasticity amounts to 140 GPa, while the lower limit of percent elongation at failure A lies at least in the range from 2% to 7%. The coefficient of thermal expansion of the exemplary alloy C amounts to $17.6*10^{-6}$ 1/K, and the thermal conductivity amounts to 320 W/mK.

Exemplary alloy D of the second further refinement is made up of 0.3 wt. % chromium, 0.1 wt. % titanium, 0.02 wt. % silicon and copper as the rest. The hardness of this exemplary alloy lies in the range from 120-190 HV. The hardness of the alloy is reduced by maximally 20% at up to 550° C. for up to 30 minutes. The modulus of elasticity amounts to 138 GPa, while the lower limit of percent elongation at failure A lies at least in the range from 2% to 8%. The coefficient of thermal expansion of exemplary alloy D amounts to $18.0*10^{-6}$ 1/K, and the thermal conductivity amounts to 310 W/mK.

A certain and negligible portion of impurities, such as further elements or oxides, may also be included in the aforementioned exemplary alloys. The impurities or oxides are not selectively added to the alloy, but are unavoidable, for instance on account of element-production processes, the production process of the alloy, and/or the storage conditions.

What is claimed is:

1. A spark plug, comprising:
a housing;
an insulator situated in the housing;
a center electrode situated in the insulator;
a ground electrode situated on the housing; and
at least one sealing element situated between the insulator and the housing, wherein the at least one sealing element is made from an at least ternary alloy, the alloy containing copper (Cu) as the main constituent;
wherein the Cu content of the alloy is no less than 40 wt. %.

2. The spark plug as recited in claim 1, wherein the alloy contains nickel (Ni), the Ni content of the alloy being no less than 7 wt. %.

3. The spark plug as recited in claim 2, wherein the alloy contains zinc (Zn), the Zn content of the alloy being no less than 10 wt. %.

4. The spark plug as recited in claim 3, wherein the Zn content of the alloy is no greater than 50 wt. %.

5. The spark plug as recited in claim 3, wherein the Zn content of the alloy is no greater than 42 wt. %.

6. The spark plug as recited in claim 3, wherein the alloy contains lead (Pb), the Pb content of the alloy being up to 2.5 wt. %.

7. The spark plug as recited in claim 6, wherein the alloy contains at least one of manganese (Mn) and iron (Fe).

8. The spark plug as recited in claim 2, wherein the alloy contains zinc (Zn), the Zn content of the alloy being no less than 15 wt. %.

9. The spark plug as recited in claim 1, wherein the alloy contains nickel (Ni), the Ni content of the alloy being no less than 10 wt. %.

10. The spark plug as recited in claim 9, wherein the Ni content of the alloy is no greater than 30 wt. %.

11. The spark plug as recited in claim 9, wherein the Ni content of the alloy is no greater than 25 wt. %.

12. A spark plug, comprising:
a housing;
an insulator situated in the housing;
a center electrode situated in the insulator;
a ground electrode situated on the housing; and
at least one sealing element situated between the insulator and the housing, wherein the at least one sealing element is made from an at least ternary alloy, the alloy containing copper (Cu) as the main constituent;
wherein the Cu content of the alloy is no less than 47 wt. %.

13. A spark plug, comprising:
a housing;
an insulator situated in the housing;
a center electrode situated in the insulator;
a ground electrode situated on the housing; and
at least one sealing element situated between the insulator and the housing, wherein the at least one sealing element is made from an at least ternary alloy, the alloy containing copper (Cu) as the main constituent;
wherein the alloy contains chromium (Cr), the Cr content of the alloy at least one of: i) being no less than 0.2 wt. %, ii) being no greater than 1 wt. %, and iii) being no greater than 0.6 wt. %.

14. A spark plug, comprising:
a housing;
an insulator situated in the housing;
a center electrode situated in the insulator;
a ground electrode situated on the housing; and
at least one sealing element situated between the insulator and the housing, wherein the at least one sealing element is made from an at least ternary alloy, the alloy containing copper (Cu) as the main constituent;
wherein the alloy contains titanium (Ti), the Ti content of the alloy at least one of: i) being no less than 0.05 wt %, ii) being no greater than 0.15 wt %, and iii) being no greater than 0.1 wt. %.

15. A spark plug, comprising:
a housing;
an insulator situated in the housing;
a center electrode situated in the insulator;
a ground electrode situated on the housing; and
at least one sealing element situated between the insulator and the housing, wherein the at least one sealing element is made from an at least ternary alloy, the alloy containing copper (Cu) as the main constituent;
wherein the alloy contains silicon (Si), the Si content of the alloy at least one of: i) being no less than 0.01 wt. %, ii) being no less than 0.02 wt. %, iii) being no greater than 0.05 wt. %, and iv) being no greater than 0.03 wt. %.

16. A spark plug, comprising:
a housing;
an insulator situated in the housing;
a center electrode situated in the insulator;
a ground electrode situated on the housing; and
at least one sealing element situated between the insulator and the housing, wherein the at least one sealing element is made from an at least ternary alloy, the alloy containing copper (Cu) as the main constituent;
wherein the alloy contains at least one of silver (Ag) and iron (Fe).

17. A spark plug, comprising:
a housing;
an insulator situated in the housing;
a center electrode situated in the insulator;
a ground electrode situated on the housing; and
at least one sealing element situated between the insulator and the housing, wherein the at least one sealing element is made from an at least ternary alloy, the alloy containing copper (Cu) as the main constituent;
wherein the alloy has a hardness of at least one of: i) no less than 80 HV, ii) no greater than 260 HV, iii) no less than 90 HV, and iv) no greater than 230 HV.

18. A spark plug, comprising:
a housing;
an insulator situated in the housing;
a center electrode situated in the insulator;

a ground electrode situated on the housing; and at least one sealing element situated between the insulator and the housing, wherein the at least one sealing element is made from an at least ternary alloy, the alloy containing copper (Cu) as the main constituent;

wherein the alloy has a hardness, and at temperatures of up to 550° C., the hardness is reduced by maximally 30% in relation to the hardness at room temperature.

19. A spark plug, comprising:

a housing;

an insulator situated in the housing;

a center electrode situated in the insulator;

a ground electrode situated on the housing; and at least one sealing element situated between the insulator and the housing, wherein the at least one sealing element is made from an at least ternary alloy, the alloy containing copper (Cu) as the main constituent;

wherein a cross-section of the sealing element has at least one of: i) a height in the range from 0.4 to 2 mm, ii) a width in the range from 0.5 to 1 mm, and iii) a diameter of 0.4 to 2 mm.

* * * * *